US005598858A

United States Patent [19]

Wainer

[11] Patent Number: 5,598,858

[45] Date of Patent: Feb. 4, 1997

[54] EYELASH CURLER

[75] Inventor: Stephanie K. Wainer, Brookline, Mass.

[73] Assignee: Corionne Consulting Company Inc., Brookline, Mass.

[21] Appl. No.: 532,892

[22] Filed: Sep. 22, 1995

[51] Int. Cl.[6] ..... A45D 2/48

[52] U.S. Cl. ..... 132/217; 132/218; 132/216; 132/223

[58] Field of Search ..... 132/217, 218, 132/216, 213, 223, 313, 317

[56] References Cited

U.S. PATENT DOCUMENTS

| | | | |
|---|---|---|---|
| D. 133,455 | 8/1942 | Tuttle et al. . | |
| D. 210,180 | 2/1968 | Solomon . | |
| D. 304,864 | 11/1989 | Stein . | |
| D. 328,504 | 8/1992 | Davies . | |
| 1,667,556 | 4/1928 | Lewis . | |
| 1,699,084 | 1/1929 | Stickel et al. | 132/217 |
| 2,159,912 | 5/1939 | Squire et al. . | |
| 2,391,047 | 12/1945 | Tuttle et al. . | |
| 2,460,317 | 2/1949 | Tuttle et al. . | |
| 2,489,099 | 11/1949 | Marcellus | 132/217 |
| 2,565,541 | 8/1951 | Wolff | 132/217 |
| 2,584,668 | 2/1952 | Brown . | |
| 2,602,458 | 7/1952 | Tuttle et al. . | |
| 2,893,404 | 7/1959 | Flynn . | |
| 3,016,059 | 1/1962 | Hutton | 132/217 |
| 3,838,699 | 10/1974 | Skandalakis . | |
| 4,305,412 | 12/1981 | Nist . | |
| 4,784,165 | 11/1988 | Stein . | |
| 4,791,944 | 12/1988 | Stein . | |
| 4,993,439 | 2/1991 | Davies . | |

FOREIGN PATENT DOCUMENTS

| | | | |
|---|---|---|---|
| 638806 | 6/1950 | United Kingdom | 132/217 |

*Primary Examiner*—Gene Mancene
*Assistant Examiner*—Pedro Philogene
*Attorney, Agent, or Firm*—Kriegsman & Kriegsman

[57] ABSTRACT

An eyelash curler comprising a stationary member and a movable member. The stationary member includes a piece of material shaped into a thumb loop at the bottom and a pair of spaced-apart posts at the top. The tops of the posts extend upwardly sufficiently so as to press against, throughout the curling process, the upper portion of a person's eye socket. An arcuately-shaped curling member interconnects the spaced-apart posts and extends a short distance on either side thereof. The bottom of the curling member is shaped to define a bottom surface, a front surface, a rear surface, a first bevelled surface extending from the front surface to the bottom surface and a second bevelled surface extending from the rear surface to the bottom surface. The internal angle between each adjacent pair of the five surfaces is approximately 135°. The movable member is pivotally connected to the stationary member and includes a second piece of material shaped into an index finger loop at the bottom and a pair of generally-parallel arms at the top. A cap is mounted over the top ends of the arms of the movable member and is adapted to press against, throughout the curling process, the cheek of a person. A support member is connected to the movable member proximate to its top end and extends upwardly therefrom. An arcuately-shaped pad holder of U-shape in lateral cross-section is fixed to the top of the support member. A resilient pad is removably seated within the pad holder. The pad, which is generally rectangular in lateral cross-section, is provided with a recessed portion into which a portion of the pad may be displaced when the curling member presses against the top portion of the pad.

20 Claims, 5 Drawing Sheets

EYELASH CURLER

BACKGROUND OF THE INVENTION

The present invention relates generally to eyelash curlers and more particularly to a novel eyelash curler.

Eyelash curlers are well-known devices used in the field of cosmetics to crimp or to bend upwardly upper eyelashes in such a manner as to make them appear longer and more full, thereby enhancing the appearance of the adjacent eye. Examples of a first type of conventional eyelash curler are disclosed in the following U.S. patents, all of which are incorporated herein by reference: U.S. Design Patent No. 133,455, inventors Tuttle et al., issued Aug. 18, 1942; U.S. Pat. No. 2,159,912, inventors Squire et al., issued May 23, 1939; U.S. Pat. No. 2,391,047, inventors Tuttle et al., issued Dec. 18, 1945; U.S. Pat. No. 2,460,317, inventors Tuttle et al., issued Feb. 1, 1949; U.S. Pat. No. 2,602,458, inventors Tuttle et al., issued Jul. 8, 1952; U.S. Pat. Nos. 2,893,404, inventor Flynn, issued Jul. 7, 1959; and U.S. Pat. No. 4,305,412, inventor Nist, issued Dec. 15, 1981.

Said first type of conventional eyelash curler typically takes the form of a metallic scissors- or pliers-like instrument comprising a stationary member and a movable member, the stationary member and the movable member being pivotally interconnected. The stationary member typically includes a wire-type or metallic member shaped into a thumb loop at the bottom and a pair of spaced-apart posts at the top. The tops of the posts include off-set arms so as to form a yoke. An arcuately-shaped jaw of rectangular cross-section interconnects the off-set arms. The movable member typically includes a wire-type or metallic member shaped into an index finger loop at the bottom and a pair of generally-parallel arms at the top. A support structure is connected to the top of the movable member and extends upwardly therefrom. An arcuately-shaped movable jaw of generally U-shape in lateral cross-section is fixed to the top of the support structure. The ends of the lower jaw are shaped to define sleeves slidably mounted on the off-set arms of the stationary member. A resilient synthetic or natural rubber or plastic pad is removably seated within the lower jaw.

To crimp a set of eyelashes using the aforementioned first type of conventional eyelash curler, the index finger loop is pivoted away from the thumb loop, and the eyelashes to be crimped are positioned between the stationary jaw and the pad. The index finger loop is then pivoted towards the thumb loop, thereby causing the pad to be moved upwardly into contact with the stationary jaw. As the rectangularly-shaped stationary jaw presses against the pad, the pad becomes compressed, forming a square-cornered "U." In this manner, the eyelashes trapped between the jaw and the pad become crimped at the two 90° angles located at the bottom corners of the "U."

The present inventor has identified certain shortcomings with the above-described first type of conventional eyelash curler. For example, the severity of the square-cornered "U" shape of the stationary jaw gives a somewhat artificial appearance to an eyelash crimped thereby. Also, maintenance of the stationary member of the curler at a stable and stationary position throughout the crimping procedure is often difficult to achieve since the curler is typically either not rested upon a person's face or, at most, is rested upon a person's face at a single location, i.e., where the top of the movable member comes into contact with the cheek. Such instability is undesirable since it can lead to, for example, the pulling out of eyelashes or the pinching of an eyelid during crimping. The problems of pulling and pinching may be compounded by the tight grip exerted on an eyelash by a square-cornered "U" shaped stationary jaw. In addition, because the pad is solid in cross-section, substantial pressure must be applied by the stationary jaw against the pad to cause the pad to be compressed into the proper shape for the eyelash to be crimped. Furthermore, because of its size, shape and design, the foregoing curler is not particularly amenable for use in curling eyelashes for eyes of substantially different size and shape. For similar reasons, the foregoing curler is limited in its capacity to enable a user to "custom-curl" a set of eyelashes, e.g., curling less than an entire set of eyelashes or curling the eyelashes located near the outer end of the eye to a greater extent than those located near the middle of the eye.

A second type of conventional eyelash curler is disclosed in the following U.S. patents, all of which are incorporated herein by reference: U.S. Design Patent No. 304,864, inventor Stein, issued Nov. 28, 1989; U.S. Pat. No. 4,784,165, inventor Stein, issued Nov. 15, 1988; and U.S. Pat. No. 4,791,944, inventor Stein, issued Dec. 20, 1988. Said second type of conventional eyelash curler typically comprises a sleeve and a plunger, the plunger being slidably mounted within the sleeve. The sleeve, which is typically made of molded plastic, is shaped at its top end to include an upper jaw and is shaped at its bottom end to include first and second finger grips. The upper jaw includes a curling bar member having a slightly rounded bottom surface providing a form around which the eyelashes may be bent. The upper jaw also include a lid guard which is said to be useful in spacing the upper jaw from the eyelid at a location on the eyelashes where maximum lift of the eyelashes can be achieved when they are curled. The sleeve, which is typically also made of molded plastic, is shaped at its top end to include a lower jaw and is shaped at its bottom end to include a thumb pad. A resilient pad member, in the form of a cylinder with a tongue, is secured at its bottom in a groove in the top of the lower jaw. The pad member presents a convex surface towards the curling bar member, with which it is aligned.

Said second type of conventional eyelash curler further comprises a spring disposed within the sleeve and around the plunger for use in biasing the lower jaw of the plunger away from the upper jaw of the sleeve. The eyelash curler is operated by positioning the curler so that the eyelashes to be curled are located between the upper and lower jaws. Then, with the index finger placed on the first finger grip, the middle finger placed on the second finger grip and the thumb placed on the thumb pad, the thumb is used to push the plunger into the sleeve until the pad member of the lower jaw is brought into contact with the curling bar member of the upper jaw, thereby closing on the eyelashes disposed therebetween.

The present inventor has identified certain shortcomings with the above-described second type of conventional eyelash curler. For example, said curler appears to be substantially less effective in curling eyelashes than, for example, said first type of conventional eyelash curler and appears to require that greater force be applied to curl eyelashes than is required by said first type of conventional eyelash curler. In fact, apparently in recognition of this shortcoming, a commercial embodiment of the second type of curler includes a recommendation that the resilient pad member be heated with a hair dryer or the like prior to use. As can readily be appreciated, however, such heating can be inconvenient and potentially dangerous to the eye. Another shortcoming with the aforementioned curler is that, because of its size and design, the curler obstructs the vision of the eye whose eyelashes are being curled when the lower jaw of the curler comes into contact with the upper jaw of the curler. Still another shortcoming with the foregoing curler is that it suffers from similar types of instability problems discussed above in connection with the first type of conventional eyelash curler. Still yet another shortcoming with the foregoing curler is that it suffers from the same types of limitations in enabling a user to custom-curl a set of eyelashes.

A third type of conventional eyelash curler is disclosed in the following U.S. patents, both of which are incorporated herein by reference: U.S. Design Patent No. 328,504, inventor Davies, issued Aug. 4, 1992; and U.S. Pat. No. 4,993,439, inventor Davies, issued Feb. 19, 1991. Said third type of conventional eyelash curler typically comprises a first arcuate curling element having end regions and a middle region, a second arcuate curling element having end regions and a middle region and adapted to co-operate with said first arcuate member to curl eyelashes, a first support member for supporting said first arcuate element at said middle region of said first arcuate element and having a portion providing guide means, a second support member supporting said second arcuate element at said middle region of said second arcuate element and slidably engaging said guide means for enabling sliding relative motion between said support members in the sense to move said first and second arcuate elements towards and away from one another, and a third member pivotally mounted to one of said support members and engageable with the other of said support members to urge the arcuate elements relatively towards one another.

The present inventor believes that said third type of conventional eyelash curler suffers from many of the same infirmities discussed above in connection with said second type of conventional eyelash curler.

Other patents that may be of interest include U.S. Des. Patent No. 210,180, inventor Solomon, issued Feb. 13, 1968; U.S. Pat. No. 3,547,135, inventor Roos, issued Dec. 15, 1970; U.S. Pat. No. 1,667,556, inventor Lewis, issued Apr. 24, 1928; U.S. Pat. No. 2,569,246, inventor Marcellus, issued Sep. 25, 1951; U.S. Pat. No. 2,684,679, inventor Kislig, issued Jul. 27, 1954; U.S. Pat. No. 3,838,699, inventor Skandalakis, issued Oct. 1, 1974; U.S. Pat. No. 2,411,519, inventor Byron, issued Nov. 26, 1946; U.S. Pat. No. 2,552,095, inventor Hickey, issued May 8, 1951; U.S. Pat. No. 1,951,130, inventor Cohn et al., issued Mar. 13, 1934; U.S. Pat. No. 2,129,755, inventor Eisenman, issued Sep. 13, 1938; U.S. Pat. No. 2,393,848, inventor Wasserman, issued Jan. 29, 1946; and U.S. Pat. No. 2,584,668, inventor Brown, issued Feb. 5, 1952.

SUMMARY OF THE INVENTION

It is an object of the present invention to provide a novel eyelash curler.

It is another object of the present invention to provide a novel eyelash curler that overcomes at least some of the shortcomings associated with conventional eyelash curlers.

It is still another object of the present invention to provide a novel eyelash curler as described above that is easy to manufacture and easy to use.

According to one aspect of the present invention, an eyelash curler is provided which comprises a curling member and a pad, the pad being movable upwardly to selectively contact the curling member in such a way as to curl eyelashes disposed therebetween, the bottom portion of the curling member having at least one bevelled surface.

In a preferred embodiment, the bottom portion of the curling member is shaped to define five surfaces including a bottom surface, a front surface, a rear surface, a first bevelled surface extending from the front surface to the bottom surface and a second bevelled surface extending from the rear surface to the bottom surface. The internal angle between each adjacent pair of the five surfaces is approximately 135°.

One advantage to using the aforementioned curling member is that each eyelash subjected thereto becomes bent at four, as opposed to two, locations along its length. Another advantage to using the foregoing curling member of the present invention is that a gradual 135° angle is introduced into the eyelash, as opposed to a harsh 90° angle. Both of these differences serve to produce a more natural-looking curl in an eyelash. Also, because the foregoing curling member of the present invention lacks a pair of 90° angles at its bottom, said curling member is less apt than said first type of conventional eyelash curler to tightly grab an eyelash during the curling process.

According to another aspect of the invention, an eyelash curler is provided which comprises a pad and a pad holder, the pad being seated within the pad holder, the pad holder being adjustably positionable to enable the pad to selectively contact a curling member in such a way as to curl eyelashes disposed between said pad and said curling member, the pad being provided with a recessed portion into which a portion of the pad may be displaced when said curling member presses against the top portion of said pad.

In a preferred embodiment, the pad holder is U-shaped in lateral cross-section, and the pad is generally rectangular in lateral cross-section, the pad being provided with a channel extending longitudinally along its bottom surface and in alignment with the curling member.

One advantage to the foregoing arrangement of pad and pad holder is that increased pressure is thereby applied between all surfaces of the curling member and the pad (and, likewise, to an eyelash disposed between the curling member and the pad).

According to still another aspect of the invention, an eyelash curler is provided which comprises a first stabilization member adapted to press against, throughout the curling process, the cheek of a person whose eyelashes are being curled and a second stabilization member adapted to press against, throughout the curling process, the upper bony structure of the eye socket of the person whose eyelashes are being curled.

In a preferred embodiment, the eyelash curler is a scissors- or pliers-like instrument comprising a stationary member and a movable member, the stationary member and the movable member being pivotally interconnected. The stationary member includes an elongated piece of material shaped into a thumb loop at the bottom and a pair of spaced-apart posts at the top. The tops of the spaced-apart posts extend upwardly sufficiently so as to press against, throughout the curling process, the upper bony structure of the eye socket of the person whose eyelashes are being curled. An arcuately-shaped curling member interconnects the spaced-apart posts and extends a short distance on either side thereof. The movable member includes a second elongated piece of material shaped into an index finger loop at the bottom and a pair of generally-parallel arms at the top. A cap is mounted over the top ends of the generally-parallel arms of the movable member and is adapted to press against, throughout the curling process, the cheek of the person whose eyelashes are being curled. A support structure is connected to the movable member proximate to its top end and extends upwardly therefrom. An arcuately-shaped pad holder of U-shape in lateral cross-section is fixed to the top of the support structure. A pair of sleeves slidably mounted on the posts of the stationary member are fixed to the pad holder. A resilient synthetic or natural rubber or plastic pad is removably seated within the pad holder.

One advantage to the foregoing arrangement is that the aforementioned eyelash curler maintains, throughout the curling process, three points of contact with the person whose eyelashes are being curled (i.e., on the cheek and at two points on the eye socket above the eye). Consequently, the aforementioned eyelash curler is less apt to move relative to the eyelashes being curled during the curling process than are conventional eyelash curlers. Because of its stability, the foregoing eyelash curler of the present invention may be used by one person to curl the eyelashes of another person.

Additional features, aspects and advantages of the present invention will be set forth in part in the description which follows, and in part will be obvious from the description or may be learned by practice of the invention. Various embodiments of the invention will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 3:
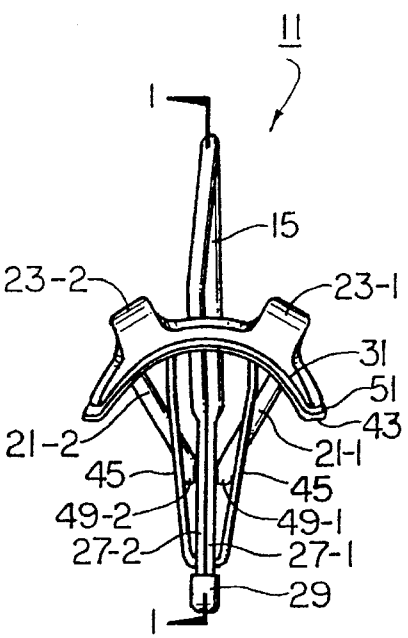
FIG. 3 is a top view of the eyelash curler shown in FIG. 1.
Figure 2:
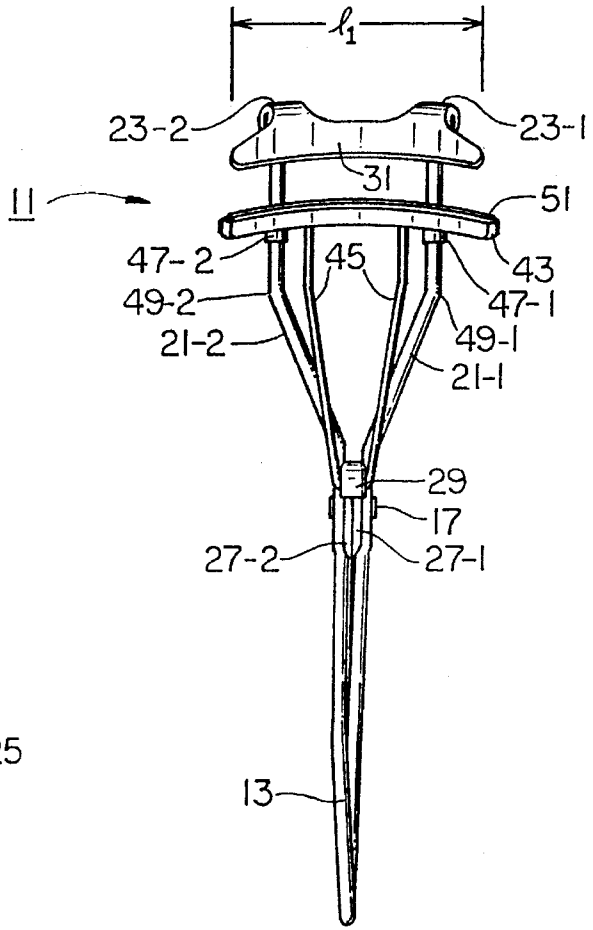
FIG. 2 is a rear view of the eyelash curler shown in FIG. 1.
Figure 1:
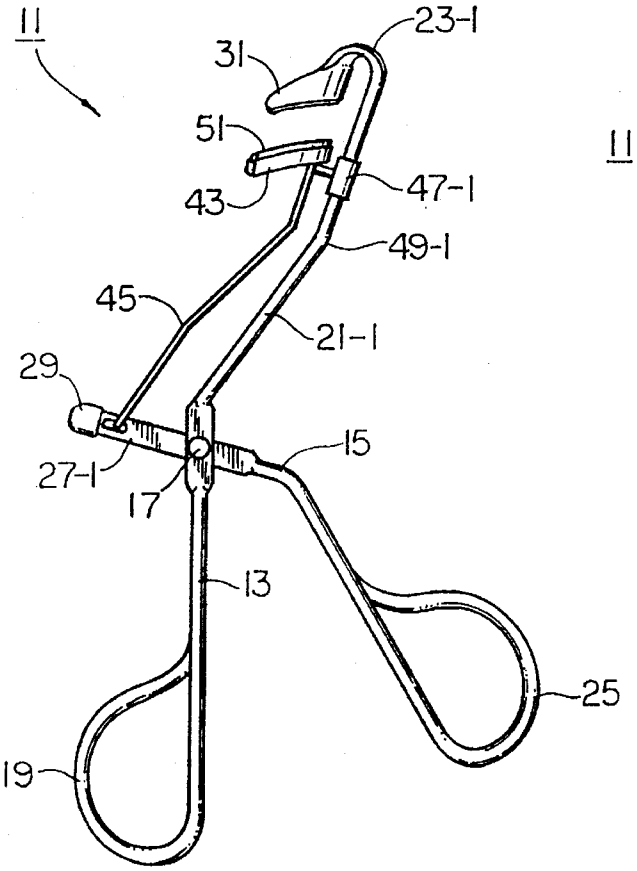
FIG. 1 is a left side view of a first embodiment of an eyelash curler constructed according to the teachings of the present invention, the eyelash curler being shown in a partially open condition.

Referring now to FIGS. 1 through 5, there are shown various views of a first embodiment of an eyelash curler constructed according to the teachings of the present invention, the eyelash curler being represented by reference numeral 11.

Curler 11, which is similar in certain respects to said first type of conventional eyelash curler described above, comprises a stationary member 13 and a movable member 15, stationary member 13 and movable member 15 being pivotally interconnected by a pin 17 to form a scissors- or pliers-like structure.

Stationary member 13, which in the present embodiment is fashioned from metal, is shaped to include a thumb loop 19 at its bottom and a pair of spaced-apart posts 21-1 and 21-2, respectively, at its top. The tops 23-1 and 23-2 of posts 21-1 and 21-2, respectively, are curved upwardly so that, for reasons that will become more apparent from the discussion below, when curler 11 is used to curl a person's eyelashes, tops 23-1 and 23-2 rest against the upper bony structure of a person's eye socket and thereby serve to provide a pair of stabilization points for curler 11 relative to the person's face.

Movable member 15, which in the present embodiment is fashioned from metal, is shaped to include an index finger loop 25 at its bottom and a pair of generally-parallel arms 27-1 and 27-2, respectively, at its top. A cap 29 is mounted over the ends of arms 27-1 and 27-2. As will be seen below, when curler 11 is used to curl a person's eyelashes, cap 29 rests against the cheek of the person and thereby provides an additional stabilization point for curler 11 relative to the person's face.

Figure 5:
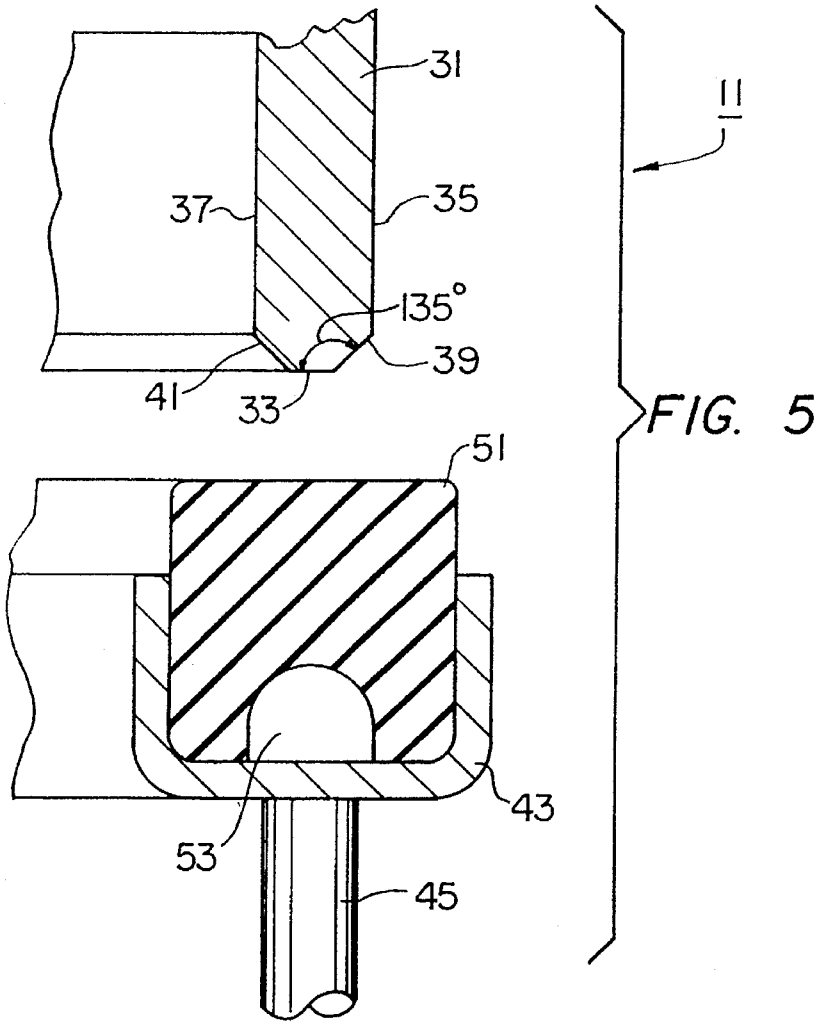
FIG. 5 is an enlarged fragmentary section view of the eyelash curler of FIG. 3 taken along line 1—1.
Figure 4:
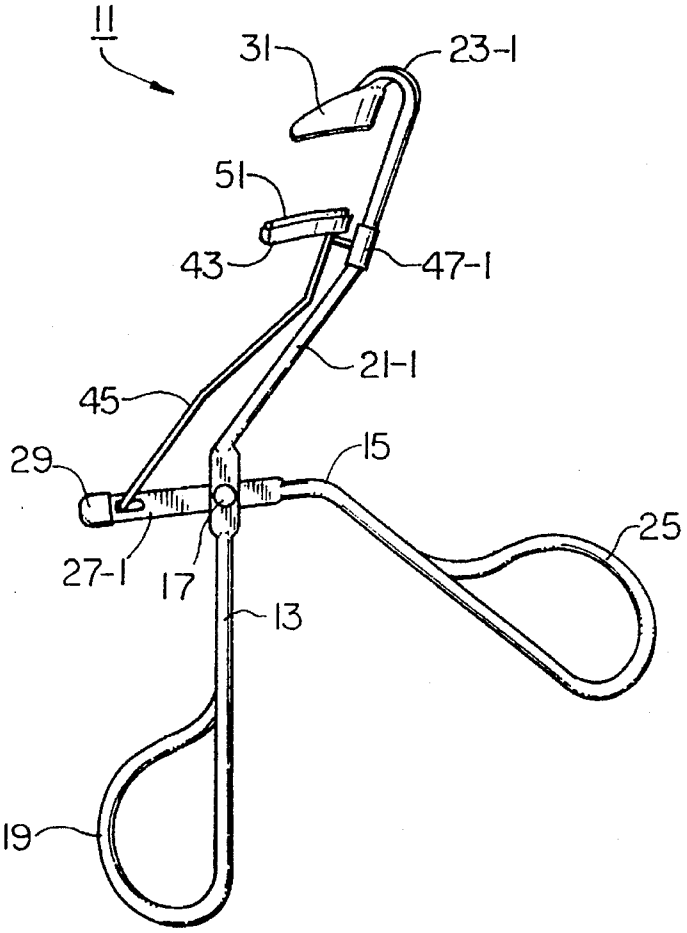
FIG. 4 is a left side view of the eyelash curler shown in FIG. 1, the eyelash curler being shown in a completely open condition.

Curler 11 further includes a curling member 31, which is disposed at the ends of and which interconnects posts 21-1 and 21-2. Curling member 31, which in the present embodiment is made of metal, is arcuately-shaped to conform generally to the shape of a person's eyelid. Referring now to FIG. 5, certain details of curling member 31 are shown. As can be seen, the bottom portion of curling member 31 is shaped to define five surfaces including a bottom surface 33, a front surface 35, a rear surface 37, a first bevelled surface 39 extending from front surface 35 to bottom surface 33 and a second bevelled surface 41 extending from rear surface 37 to bottom surface 33. The internal angle between each adjacent pair of the five surfaces is approximately 135°.

Referring back to FIGS. 1 through 4, curler 11 further includes a pad holder 43. In the present embodiment, pad holder 43 is made of metal and is U-shaped in lateral cross-section. Pad holder 43, which is aligned with and has a similar curvature to curling member 31, is mechanically coupled to movable member 15 by a support member 45 (also made of metal in the present embodiment). In addition, pad holder 43 is slidably mounted on posts 21-1 and 21-2 of stationary member 13 by means of a pair of sleeves 47-1 and 47-2, respectively, which are fixedly mounted on holder 43. Sleeves 47-1 and 47-2, in conjunction with bends 49-1 and 49-2, respectively, of posts 21-1 and 21-2, limit the range of downward movement of pad holder 43 relative to curling member 31 (see FIG. 4).

Curler 11 further includes a pad 51 of resilient rubber or plastic material. Pad 51 is removably seated within pad holder 43. Referring to FIG. 5, a longitudinally-extending channel 53 is formed along the bottom of pad 51. As mentioned above, the function of channel 53 is to provide a space into which a portion of pad 51 may be displaced when curling member 31 presses down against the top portion of pad 51. This enables increased pressure to be applied between the five surfaces of the bottom of curling member 31 and pad 51 (and, likewise, to an eyelash disposed between curling member 31 and pad 51), while reducing the amount of pressure needed to be applied by the user. The shape of channel 53 in FIG. 5 is intended to be illustrative only, and it is contemplated that channel 53 may take a variety of shapes and be formed at a variety of locations within and around pad 51.

Figure 6B:
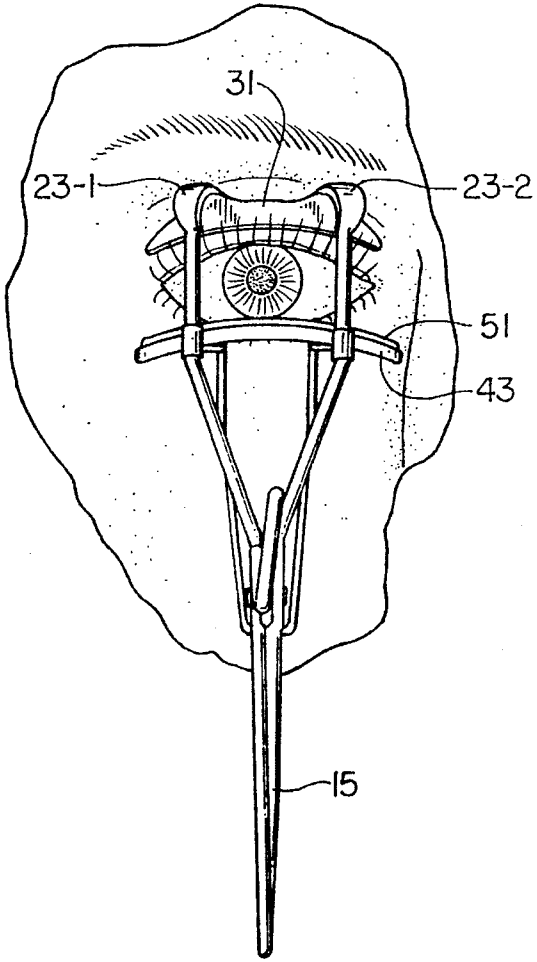
FIGS. 6(*a*) and 6(*b*) are front and side views, respectively, of the eyelash curler of FIG. 1, showing the eyelash curler in use at the beginning of the curling process.
Figure 6A:
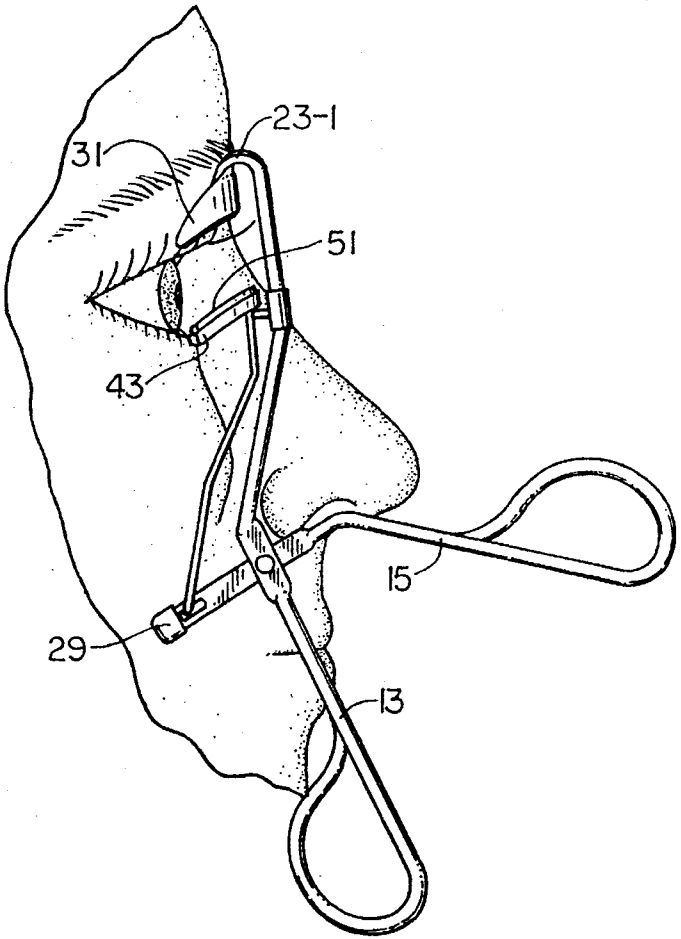
Figure 7B:
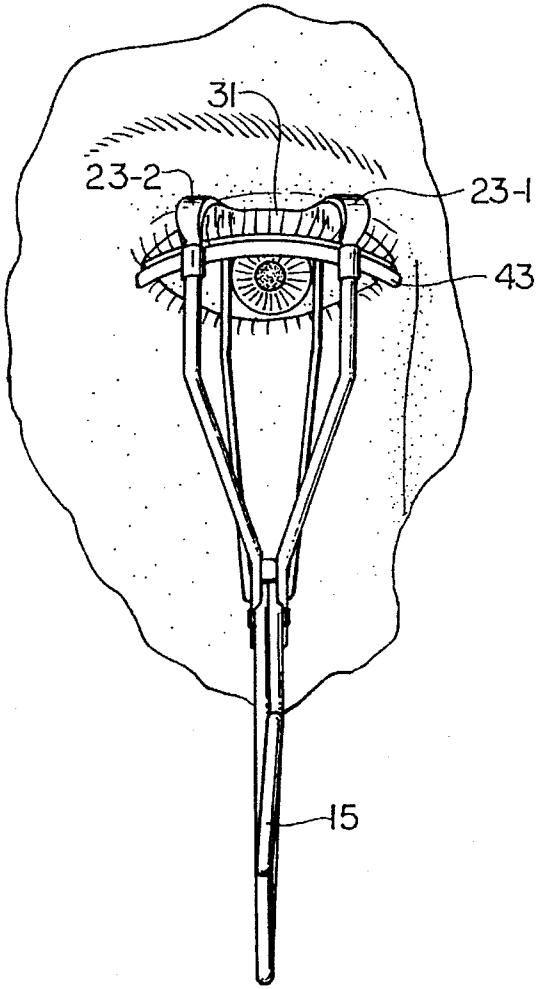
FIGS. 7(*a*) and 7(*b*) are front and side views, respectively, of the eyelash curler of FIG. 1, showing the eyelash curler in use at the end of the curling process.
Figure 7A:
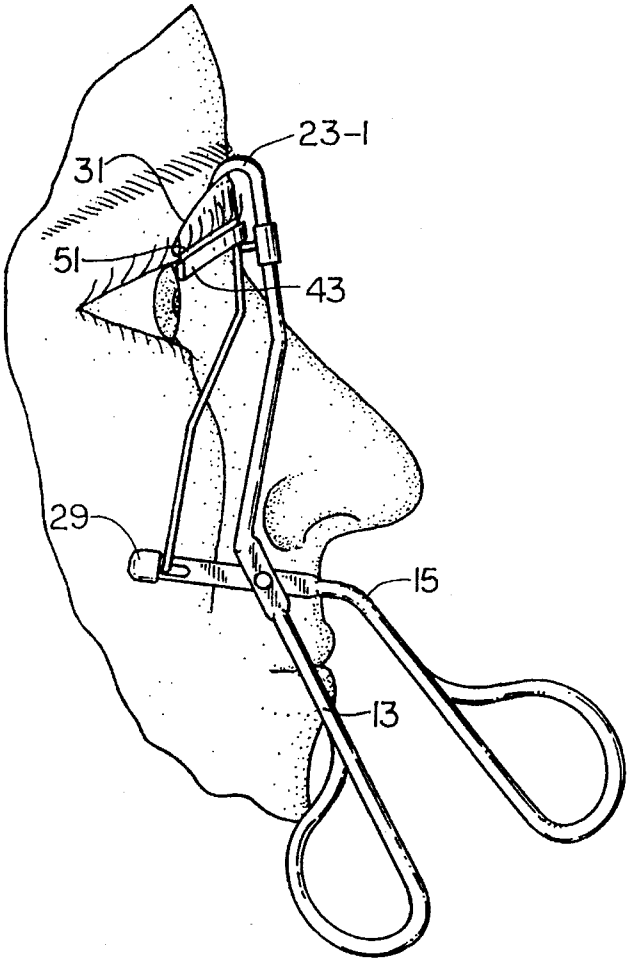

For a user to curl his/her own eyelashes using curler 11, the user typically first moves pad holder 43 and pad 51 away from curling member 31 by pivoting movable member 15 away from stationary member 13. The user then positions curler 11 relative to the user's face so that (a) the eyelashes to be curled are located between curling member 31 and pad 51; (b) cap 29 is in contact with the user's cheek; and (c) tops 23-1 and 23-2 of posts 21-1 and 21-2, respectively, are both in contact with the upper bony structure of the eye socket of the user (see FIGS. 6(*a*) and 6(*b*)). Then, while maintaining the aforementioned three points of stable contact between curler 11 and the user's face, the user moves pad holder 43 and pad 51 into contact with curling member 31 by pivoting movable member 15 towards from stationary member 13 (see FIGS. 7(*a*) and 7(*b*)). Those eyelashes trapped between curling member 31 and pad 51 become curled at the four 135° angles located at the bottom of curling member 31.

It is believed that eyelashes curled using curler 11 have a more "natural look" than is typically achieved with conventional eyelash curlers (said first type of conventional eyelash curler typically resulting in eyelashes which are bent too harshly whereas said second and said third types of conventional eyelash curlers typically resulting in eyelashes which are bent too weakly). Also, because curling member 31 lacks a pair of 90° angles at its bottom, curling member 31 is less apt than said first type of conventional eyelash curler to tightly grab an eyelash during the curling process. Furthermore, because curler 11 provides for three points of contact with a user's face, curling member 31 and/or pad 51 are less likely than conventional eyelash curlers to move relative to the user's face.

Another advantage of curler 11 over certain conventional eyelash curlers is that the vision of the eye whose eyelashes are being curled is minimally obstructed throughout the entire curling process (even when pad 51 is in contact with curling member 31).

As can readily be appreciated, curler 11 could be made partially or entirely of molded plastics or other suitable materials, instead of being made predominately of metal.

As can also readily be appreciated, one could modify various types of conventional eyelash curlers to include one or more of the novel features of curler 11. For instance, the second type of conventional eyelash curler discussed above could be modified to include a curling member, such as curling member 31, and/or a pad, such as pad 51.

Figure 9:
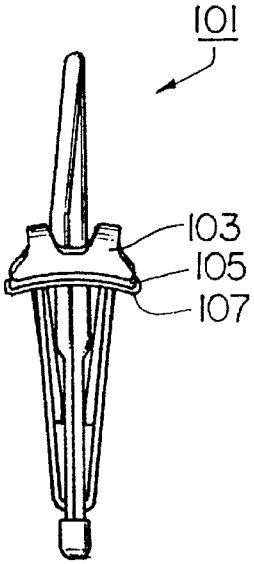
FIG. 9 is a top view of the eyelash curler of FIG. 8.
Figure 8:
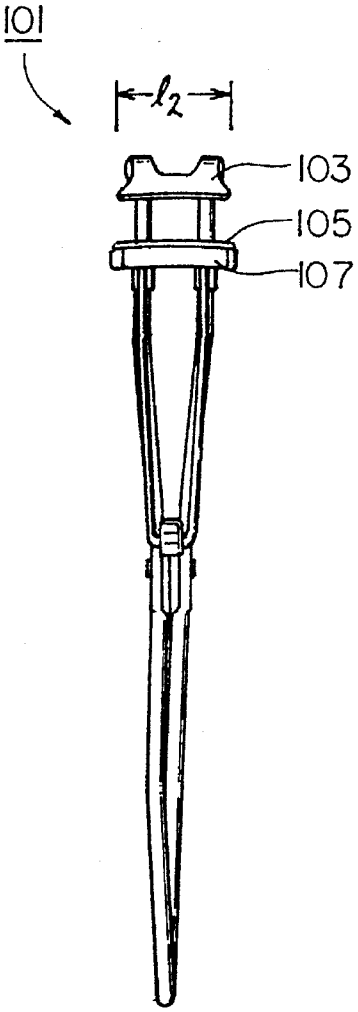
FIG. 8 is a rear view of a second embodiment of an eyelash curler constructed according to the teachings of the present invention.

Referring now to FIGS. 8 and 9, there are shown rear and top views, respectively, of a second embodiment of an eyelash curler constructed according to the teachings of the present invention, the eyelash curler being represented generally by reference numeral 101.

Eyelash curler 101 is substantially identical to eyelash curler 11, the principal differences between eyelash curlers 11 and 101 being that (1) curling member 103, pad 105 and pad holder 107, all of curler 101, are substanitally less curved, such as when viewed from the top, than are curling member 31, pad 51 and pad holder 43, all of curler 11; and (2) the lengths of curling member 103, pad 105 and pad holder 107 are approximately one-third the lengths of curling member 31, pad 51 and pad holder 43, respectively. (To illustrate, the length $l_1$ of curling member 31 is approximately 40 mm whereas the length $l_2$ of curling member 103 is approximately 13 mm.)

Because of its comparatively short and flat design, as compared to curler 11, curler 101 is particularly well-suited to enable a user to "custom-curl" a set of eyelashes by curling only a few eyelashes at a time. In addition, because of its comparatively small size, curler 101 can be used to curl eyelashes of people having widely varying eye sizes and shapes.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An eyelash curler comprising:

(a) a curling member, said curling member having a bottom portion, said bottom portion having at least one straight bevelled surface;

(b) a pad, said pad being positioned below said bottom portion of said curling member, said pad having a top portion; and (c) means for vertically controllably opposing said pad and said curling member so as to enable the curling of eyelashes between said bottom portion of said curling member and the top portion of said pad.

2. The eyelash curler as claimed in claim 1 wherein said means for vertically controllably opposing said curling member and said pad comprises a pair of crossed, finger-controllable members pivoted to each other in a scissors-like configuration, one of said crossed, finger-controllable members being mechanically coupled to said curling member, the other of said crossed, finger-controllable members being mechanically coupled to said pad.

3. The eyelash curler as claimed in claim 1 further comprising a pad holder, said pad being seated within said pad holder and being provided with a recessed portion into which a portion of said pad may be displaced when said curling member presses against the top portion of said pad.

4. An eyelash curler comprising:

(a) a curling member, said curling member having a bottom portion, said bottom portion of said curling member being shaped to define a bottom surface, a front surface, a rear surface, a first bevelled surface extending from said front surface to said bottom surface and a second bevelled surface extending from said rear surface to said bottom surface;

(b) a pad, said pad being positioned below said bottom portion of said curling member, said pad having a top portion;

(c) means for vertically controllably opposing said pad and said curling member so as to enable the curling of eyelashes between said bottom portion of said curling member and the top portion of said pad.

5. The eyelash curler as claimed in claim 4 wherein each of the internal angles between said front surface and said first bevelled surface, said first bevelled surface and said bottom surface, said bottom surface and said second bevelled surface, and said second bevelled surface and said rear surface is approximately 135°.

6. An eyelash curler comprising:

(a) a curling member, said curling member having a bottom portion, said bottom portion having at least one bevelled surface;

(b) a pad, said pad being positioned below said bottom portion of said curling member, said pad having a top portion and a bottom surface and being generally rectangular in lateral cross-section, said pad having a recessed portion comprising a longitudinally-extending channel along its bottom surface into which a portion of said pad may be displaced when said curling member presses against the top portion of said pad;

(c) means for vertically controllably opposing said pad and said curling member so as to enable the curling of eyelashes between said bottom portion of said curling member and the top portion of said pad; and (d) a pad holder, said pad being seated within said pad holder, said pad holder being U-shaped in lateral cross-section.

7. An eyelash curler comprising:

(a) curling member;

(b) a pad holder;

(c) a pad, said pad being positioned below said curling member and being seated within said pad holder, said pad having a top portion and being provided with a recessed portion into which a portion of said pad may be displaced upon application of pressure to the top portion of said pad; and (d) means for vertically controllably opposing said pad and said curling member so as to enable the curling of eyelashes therebetween.

8. An eyelash curler comprising:

(a) a curling member;

(b) a pad holder, said pad holder being U-shaped in lateral cross-section;

(c) a pad, said pad being positioned below said curling member and being seated within said pad holder, said pad being generally rectangular in lateral cross-section, said pad having a top portion and a bottom surface and having a recessed portion comprising a longitudinally-extending channel along its bottom surface into which a portion of said pad may be displaced upon application of pressure to the top portion of said pad; and (d) means for vertically controllably opposing said pad and said curling member so as to enable the curling of eyelashes therebetween.

9. An eyelash curler comprising:

(a) a curling member, said curling member having a pair of ends;

(b) a pad, said pad being positioned below said curling member;

(c) means for vertically controllably opposing said pad and said curling member so as to enable the curling of eyelashes therebetween;

(d) a first stabilization member adapted to press against the cheek of a person whose eyelashes are being curled; and (e) a second stabilization member adapted to press against the upper bony structure of the eye socket of a person whose eyelashes are being curled, said second stabilization member comprising a post extending upwardly from and connected to said curling member at a point spaced inwardly from the pair of ends of said curling member.

10. The eyelash curler as claimed in claim 9 further comprising a third stabilization member adapted to press against the upper bony structure of the eye socket of a person whose eyelashes are being curled.

11. The eyelash curler as claimed in claim 9 wherein said means for vertically controllably opposing said curling member and said pad comprises a pair of crossed, finger-controllable members pivoted to each other in a scissors-like configuration, one of said crossed, finger-controllable members being mechanically coupled to said curling member, the other of said crossed, finger-controllable members being mechanically coupled to said pad.

12. An eyelash curler comprising:

(a) a curling member, said curling member having a bottom portion, said bottom portion having at least one straight bevelled surface;

(b) a pad, said pad being positioned below said curling member; and (c) a pair of crossed, finger-controllable members pivoted to each other in a scissors-like configuration, a first of said crossed, finger-controllable members being mechanically coupled to said curling member and having a pair of upwardly extending posts adapted to securely engage the upper bony structure of the eye socket of a person whose eyelashes are being curled, a second of said crossed, finger-controllable members being mechanically coupled to said pad and having means for pressing against the cheek of a person whose eyelashes are being curled.

13. The eyelash curler as claimed in claim 12 further comprising a pad holder, said pad being seated in said pad holder, and a support member, said support member mechanically coupling said pad holder to said second of said crossed, finger-controllable members.

14. The eyelash curler as claimed in claim 13 wherein said pad is provided with a recessed portion into which a portion of said pad may be displaced upon application of pressure to the top portion of said pad.

15. An eyelash curler comprising:

(a) a curling member;

(b) a pad, said pad being positioned below said curling member; and (c) a pair of crossed, finger-controllable members pivoted to each other in a scissors-like configuration, a first of said cross, finger-controllable members being mechanically coupled to said curling member and having a pair of upwardly extending posts adapted to securely engage the upper bony structure of the eye socket of a person whose eyelashes are being curled, said upwardly extending posts being connected to said curling member at points spaced inwardly from the ends of said curling member and a second of said crossed, finger-controllable members being mechanically coupled to said pad and having means for pressing against the cheek of a person whose eyelashes are being curled.

16. The eyelash curler as claimed in claim 15 wherein said curling member has a bottom portion, said bottom portion having at least one bevelled surface.

17. The eyelash curler as claimed in claim 15 wherein said pad has a top portion and wherein said pad is provided with a recessed portion into which a portion of said pad may be displaced upon application of pressure to the top portion of said pad.

18. An eyelash curler comprising:

(a) a curling member, said curling member having a bottom portion, said bottom portion of said curling member being shaped to define a bottom surface, a front surface, a rear surface, a first bevelled surface extending from said front surface to said bottom surface and a second bevelled surface extending from said rear surface to said bottom surface;

(b) a pad, said pad being positioned below said curling member; and (c) a pair of crossed, finger-controllable members pivoted to each other in a scissors-like configuration, a first of said cross, finger-controllable members being mechanically coupled to said curling member and having a pair of upwardly extending posts adapted to securely engage the upper bony structure of the eye socket of a person whose eyelashes are being curled and a second of said crossed, finger-controllable members being mechanically coupled to said pad and having means for pressing against the cheek of a person whose eyelashes are being curled.

19. The eyelash curler as claimed in claim 18 wherein each of the internal angles between said front surface and said first bevelled surface, said first bevelled surface and said bottom surface, said bottom surface and said second bevelled surface, and said second bevelled surface and said rear surface is approximately 135°.

20. An eyelash curler comprising:

(a) a curling member;

(b) a pad holder, said pad holder being U-shaped in lateral cross-section;

(c) a pad, said pad being seated in said pad holder and positioned below said curling member, said pad being generally rectangular in lateral cross-section, said pad having a top portion and a bottom surface and having a recessed portion comprising a longitudinally-extending channel along its bottom surface into which a portion of said pad may be displaced upon application of pressure to the top portion of said pad;

(d) a pair of crossed, finger-controllable members pivoted to each other in a scissors-like configuration, a first of said cross, finger-controllable members being mechanically coupled to said curling member and having a pair of upwardly extending posts adapted to securely engage the upper bony structure of the eye socket of a person whose eyelashes are being curled and a second of said crossed, finger-controllable members being mechanically coupled to said pad and having means for pressing against the cheek of a person whose eyelashes are being curled; and (e) a support member, said support member mechanically coupling said pad holder to said second of said crossed, finger-controllable members.

* * * * *